United States Patent [19]

Nishiyama et al.

[11] 3,944,514

[45] Mar. 16, 1976

[54] PROCESS FOR THE MANUFACTURE OF RESIN-COATED REFRACTORY PARTICLES, PREFERABLY SAND

[75] Inventors: Keizo Nishiyama, Handa; Yasushi Yoshida, Kawanishi; Mutsumi Yamazaki, Osaka; Kohshi Iwata, Nagoya; Yoshiaki Tanaka, Takaishi, all of Japan

[73] Assignee: Kabushiki Kaisha Jidoshokki Seisakusho, Japan

[22] Filed: Mar. 18, 1974

[21] Appl. No.: 452,461

[30] Foreign Application Priority Data

Mar. 22, 1973 Japan ..... 48-32834
Oct. 3, 1973 Japan ..... 48-110532

[52] U.S. Cl. ..... 260/38; 164/43; 260/57 C; 260/DIG. 40

[51] Int. Cl.[2] ..... C08L 61/10

[58] Field of Search ..... 164/43; 260/38, DIG. 40, 260/838, 57 C

[56] References Cited

UNITED STATES PATENTS 2,997,759 8/1961 Froberger ..... 260/DIG. 40

OTHER PUBLICATIONS

T. S. Carswell, Phenoplasts, 1947, p. 14.

*Primary Examiner*—M. J. Welsh
*Assistant Examiner*—S. M. Person
*Attorney, Agent, or Firm*—Holman & Stern

[57] ABSTRACT

A process for the manufacture of resin coated sand by mixing under agitation a mass of sand upon heated and with solid ammonia-catalyzed resol having methylol index 15 – 30 and softening point higher than 80°C.

8 Claims, 4 Drawing Figures

PROCESS FOR THE MANUFACTURE OF RESIN-COATED REFRACTORY PARTICLES, PREFERABLY SAND

BACKGROUND OF THE INVENTION

This invention relates to a process for the manufacture of resol type resin-coated refractory granules, especially sand, especially adapted for use casting core molds, said coating resin being characterized by a minimum nitrogen content.

It has been commonly known to coat granular refractory material, especially sand, with novolac type phenolic resin added with 10 – 15 wt. % of hexamine as hardening agent, in order to prepare casting molds and cores for use in the shell molding technique as a most broadly prevailing means.

While the use of hexamine as hardening agent for novolac type phenolic resin accelerates substantially the hardening velocity thereof, thus representing a superior and advantageous feature as the hardener, it generates a substantial amount of gaseous nitrogen through thermal decomposition of the hexamine by contact with higher temperature molten metal in the course of moulding of cast iron or cast steel products, thereby inviting numerous gas defects, such as pin holes and blow holes. The gaseous nitrogen frequently includes vaporized amine which deteriorates in the ambient atmosphere and gives out a noxious smell during the preparation stage of the molds and cores as well as the pouring stage. Improvements in this respect are strongly desired for the prevention of industrial pollution.

Various proposals have therefore been made for the production of sand-coating resin including no, or only such a limited amount of nitrogen as to provide substantially no harmful effect. As an example, paraformaldehyde has been used as a hardening agent for novolac type phenolic resin, since this substance can act as a supply source of formaldehyde and harden the phenolic resin upon heating.

However, when refractory sand coated with paraformaldehyde containing is used for the preparation of shell molds and cores, the molds and cores frequently are distorted or even damaged due to defective thermal hardening of the coated resinous layer, when the shells are taken out of their respective master molds. In addition, a smoke of unhealthy poisonous gases is released during the hardening operation.

Further, it is also known to use resol type phenolic resin as the hardener for novolac type phenolic resin and conditioned with a catalyst such as an alkali or alkali earth metal in the form of oxide or hydroxide thereof. With the use of resol type phenolic resin conditioned with catalyst, preferably alkali metal oxide or the like, a grave drawback may be encountered in that the resin has a strong tendency to absorb moisture due to an appreciable residual quantity of the catalyst in the resin substrate. This tendency leads to weakening of the strength of the molds prepared therefrom and becomes rather appreciable in a high moisture environment as met in Japan. By absorbing an appreciable amount of moisture, the coated sand, originally having an easily flowing state, conglomerates which means a substantial drawback in the art. Due to the high viscosity of this kind of resin, highly fluidous resin coated sand can only be prepared through a long kneading step, resulting in a high difficulty of practical utilization thereof.

In consideration of the above facts including the adverse effect of the residual alkali metal and with the intentional utilization of self-hardenability of resol type phenolic resin, intensified attention has been directed by those skilled in the art towards the use of resol type phenolic resin conditioned with an ammonia catalyst.

The term "resol type phenolic resin" as used throughout the present specification and in the appended claims means such a resin which can be prepared from 1 mole of phenol and at least 1 mole of formaldehyde which are reacted with each other in the presence of an alkaline catalyst. This resin can be classified into two general classes. The first one is such a resin normally called "resol" which can be prepared in the presence of said alkali metal hydroxide or the like catalyst. The second one is such a resin normally called "ammonia-catalyzed resol" which can be prepared in the presence of such a catalyst as ammonia, primary amine, such as, preferably, monoethyl amine, monomethyl amine, secondary amine, such as, preferably, diethyl amine, dimethyl amine, or the like. The said resol is obtainable in the form of a viscous liquid and has water solubility and hydrophilic properties. It is soluble in organic solvents such as alcohol, acetone, and the like, and utilized frequently and broadly as a varnish.

On the other hand, ammonia-catalyzed resol can be obtained not only in the form of a viscous liquid, but also a solid, depending upon the reacting conditions; and, as a specific feature, it can be hydrophobic and soluble in organic solvents such as alcohol, acetone and the like.

The solid ammonia-catalyzed resol has the following several predominant utilities over the liquid state resin.

1. It is easily treated in various processing stages due to its solid state.

2. Resol resin has self-condensability, thus being highly limited in its storage term and conditions. Liquid state resol resin can generally be stored only for approximately three months, while solid state resol can be stored as long as 6 months in its stabilized condition.

However, the following substantial difficulties have been met in the preparation of solid state resol.

In order to guarantee the stabilized storability even in a high temperature environment as above specified, the resin must have its softening point ranging between 80° and 85°C and, for assuring such softening point, the final heating temperature of the resin should be higher by about 20°C than the above specified softening point. Due to self-condensability of the resol resin, when heated to approximately 100°C, the condensation of the resin progresses in the mode of a chain reaction, and the reaction velocity rises to an extremely accelerated rate in such manner that with a 1°C temperature rise, it increases about ten times; thus a desired velocity control is practically impossible. Reports can be found from the literature of the known resin molding or laminating process such that the final processing temperature of resol resin is limited to approximately from 70°C to 75°C, for easy manufacture of the final products.

In order to manufacture resol resin on a large scale, the reaction vessel generally has a volumetric capacity of 3,000 – 10,000 liters. In this case, it is inhibitingly difficult to quench such a large amount of the resin, once heated up to approximately 100°C, for approximately 30 minutes on an industrial scale in order to prevent the self-condensation. Or more specifically, resins are generally heat-insulating and thus it is highly difficult to effectively cool resinous products from outside until the core portions thereof have been cooled down. In fact, the self-condensing reaction progress rapidly within the interior parts of the products under cooling, inviting an exothermic reaction in an abrupt and explosive manner and in the solidifying direction.

In addition to various and profound difficulties as met in the manufacture of solid state resol, it should be further noted that difficulties are encountered in the manufacture of solid resol resin devoid of aqueous moisture content, for assuring a favorable and efficient coating ability thereof, as well as an improved storage stability.

As an example, if removal of the aqueous content from the reaction product simply by exposing it under normal pressure to a high temperature atmosphere is tried, the thus caused temperature rise of the product will further accelerate the reaction, thereby abruptly reducing the number of methylol radicals contained therein and subjecting the resin-coated granules to a retarded resin-hardening velocity. This will lead naturally to a corresponding reduction in the binding strength of the molds or the like final products prepared therefrom.

SUMMARY OF THE INVENTION

It is therefore, a main object of the present invention to provide a process for the preparation of a composition comprising refractory granules, preferably sand, coated with resin, devoid of the aforementioned various conventional drawbacks.

A further object is to provide a process of the above kind for the production of resin-coated granules wherein the resin layer has an efficient and quick hardenability and is practically devoid of evaporative constituents, or more specifically aqueous content.

Still a further object is to provide the process of the above kind wherein the prepared composition is likely to produce only a minimum amount of irritating unhealthy gases and thus highly suitable for use in the shell-molding technique.

These and further objects of the invention will become more apparent from the following detailed description of the invention by reference to accompanying drawings and several numerical examples to be set forth.

DETAILED DESCRIPTION OF THE INVENTION

Figure 1:
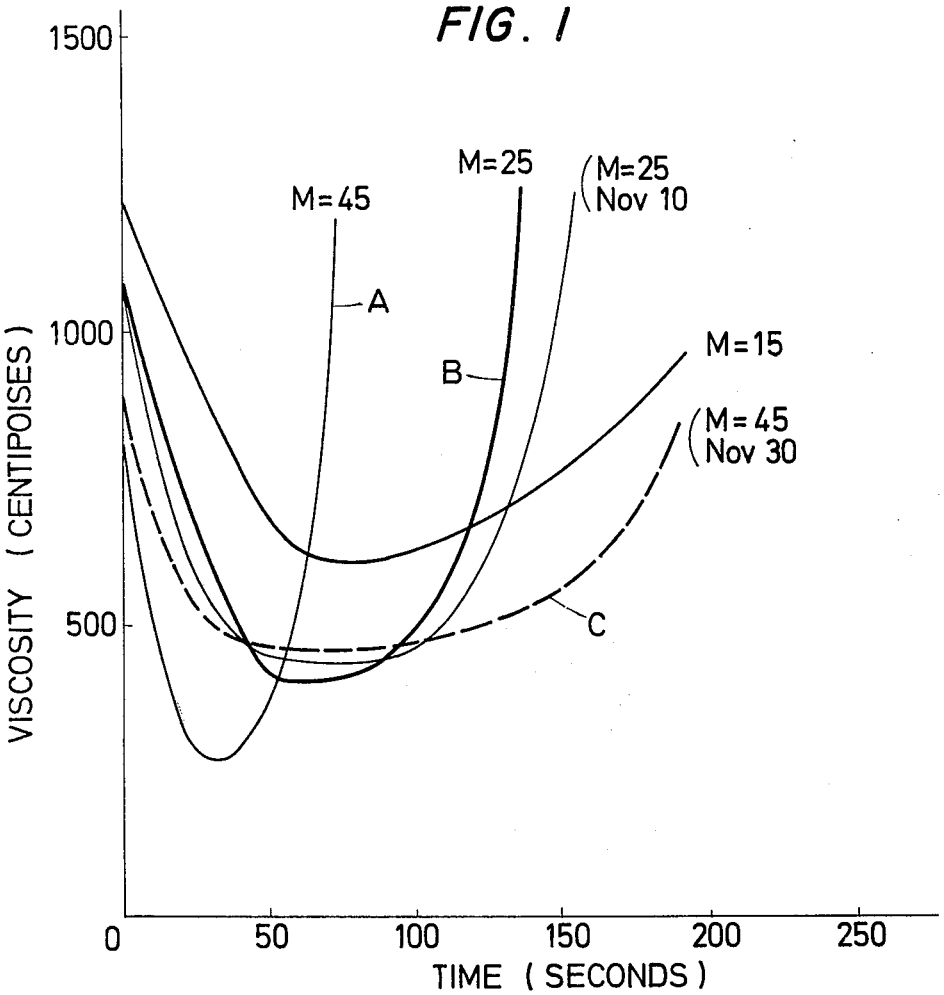
FIG. 1 is an explanatory chart of the viscosity of ammonia-catalyzed resol plotted against the heating time period.

At first, a process for the manufacture of ammonia-catalyzed resol which can be used in the process according to this invention will be briefly described.

First, in a reaction vessel of a proper capacity, 1 mole of phenol or its equivalent and 1 – 3 moles of formaldehyde or its equivalent are charged, together with catalyzing quantity of ammonia, amine or its equivalent, and they are heated to a temperature of 50° – 100°C preferably 50° – 70°C.

In this way, an addition-condensation reaction will initiate and then, the reaction temperature is maintained for a certain predetermined time period according to the following Table 1.

Table 1

| Temperature, °C | Duration Period, minutes |
|---|---|
| 70 | 100 |
| 100 | 30 |

The intermediate values can be properly selected from these exemplarly given extreme values.

Next, the addition-condensation products are treated at reduced pressure and at a temperature of 70°C or less, thus the reaction progress being suppressed, in order to allow the removal of the contained aqueous content from the reaction products. The operation period can extend for approximately 60 minutes as a representative example. Due to this removal of aqueous content, the reaction products will change their appearance from a cream color tone to a yellow and semitransparent one.

Then, while continuing the thermal condensation, the reaction pressure is further reduced so as to remove rapidly the condensation water produced so that the reaction products attain the critical condensation temperature range of 90° – 120°C, normally and preferably 100°C. For this operation, a time period of about 40 – 60 minutes as a representative example is consumed.

Upon attainment of the critical temperature range, the reaction products, when in a small batch, for instance less than 100 kgs., are discharged into a cooling water pool. If the products are in a large quantity batch, for instance larger than 1 ton, the heating temperature is so controlled that small quantities thereof are successively heated just enough to execute the thermal addition condensation upon attainment of the yellow and semitransparent state, until they arrive at the critical temperature range. Then, they are successively discharged into a cold water pool for quenching.

Conventionally prepared solid state ammonia-catalyzed resol includes only a small quantity of methylol radicals, thus representing a rather slower hardening velocity and a small cross linkage density, thereby leading to an inferior binding strength of the molds and the like final products prepared from sand coated therewith.

However, by employing the aforementioned precisely controlled manufacturing process steps, the number of the included methylol radicals can be increased substantially. It should be, however, noted that the presence of an excess number of methylol radicals will result in a correspondingly smaller molecular weight. In this case, when the composition comprises such resin, the heating of the latter will produce a suddenly lowered viscosity which will rapidly rise during the course of a rapid and substantial hardening reaction. Thus the coated sand is not able to keep its freely flowing state for necessary time period until it solidifies. This leads to a lowered strength of the baked final products prepared from such coated sand, preferably in the form of shell molds and cores. (Refer to curve A in FIG. 1.)

The ammonia-catalyzed resol contains a theoretical amount of approximately 1% of nitrogen from the ammonia used as the catalyst; although the residual amount of nitrogen is substantially smaller than the quantity of hexamine (hardening agent) which has been dispensed with. Such residual amount of nitrogen corresponds to a delicate lower limit for invitaton of defects of the cast products. In the case of the production of high class cast iron or cast steel products by use of the shell molds and cores, however, such residual nitrogen may react sensitively with the iron or steel, as the case may be, giving rise to the formation of undesirable gas holes or the like defects in the castings.

It would be conceivable to use resorcinol or other quick-acting hardening accelerators as additives to the resin for accelerating the hardening reaction. Such resorcinol constitutes, however, a unified organic compound which is easily gasified at an elevated temperature, and thus tends to foul the factory atmosphere during the pouring operation of a molten metal. A further inherent drawback resides in the blocking of resin-coated sand and in the inferior strength of the finally shaped shell products. During removal of the castings from the shell molds, breakage thereof and peel-back phenomenon can result.

As will be apparent from the foregoing, the ammonia-catalyzed resol as being used in the present invention includes a large quantity of methylol radicals, as a predominant feature of the invention.

As a most reliable measure or index for the determination of contained quantity of methylol radicals in the resin, we have adopted throughout the specification and in the appended claims, the concept of "methylol index" which can be determined in turn in such a way that the prepared resin is dissolved in acetone to provide a 50%-acetone solution and an infrared absorbtion analysis is performed noting the characteristic absorption of benzene core at 1,600 kayser and that of methylol at 1,000 – 1,050 kayser of the infrared absorption spectrum. These are measured for defining a ratio therebetween which defines said index when expressed in percentage.

Figure 2:
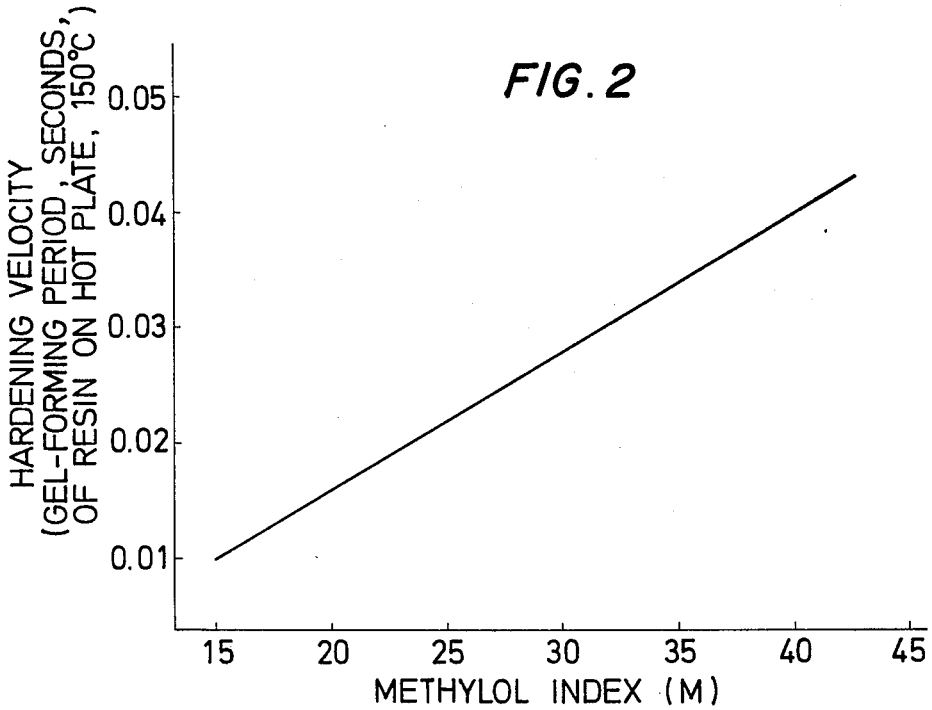
FIG. 2 is a further chart of the hardening velocity of ammonia-catalyzed resol plotted against the methylol index.
Figure 3:
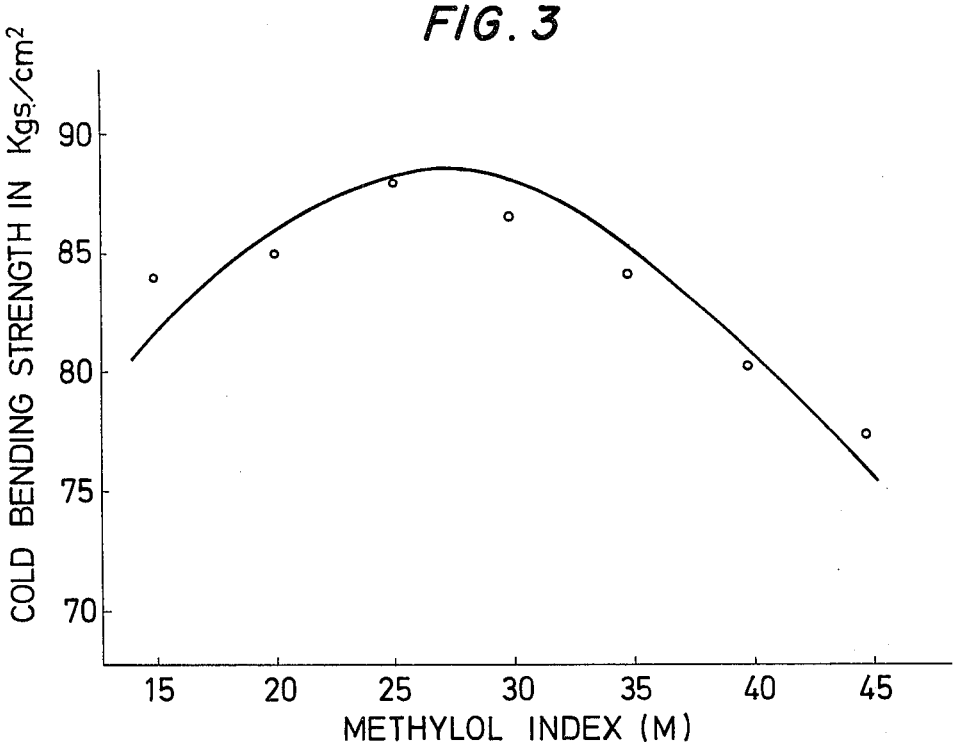
FIG. 3 is a further chart illustrative of the relationship between the cold bending strength, kg/cm$^2$, and the methylol index.

Such ammonia-catalyzed resol having a relatively high value of methylol index can be obtained by selecting a proper mixing ratio of phenol or its equivalent and formaldehyde and by adopting a properly and precisely controlled condensation-cooling process steps. As shown specifically in FIG. 2, the hardening velocity will be accelerated with increase of the methylol index. On the other hand, as shown in FIG. 3, the cold bending strength varies along a peaked curve, having its peak positioned at a methylol index of about 25. As may be well supposed from the curve B in FIG. 1, ammonia-catalyzed resol having methylol index 25 represents a satisfactory cross-linkage density and an optimal viscosity for allowing enough flowable condition among the resin-coated sand particles, to be kept for a desirously long processing period necessary for performing the shell-forming operation.

Figure 4:
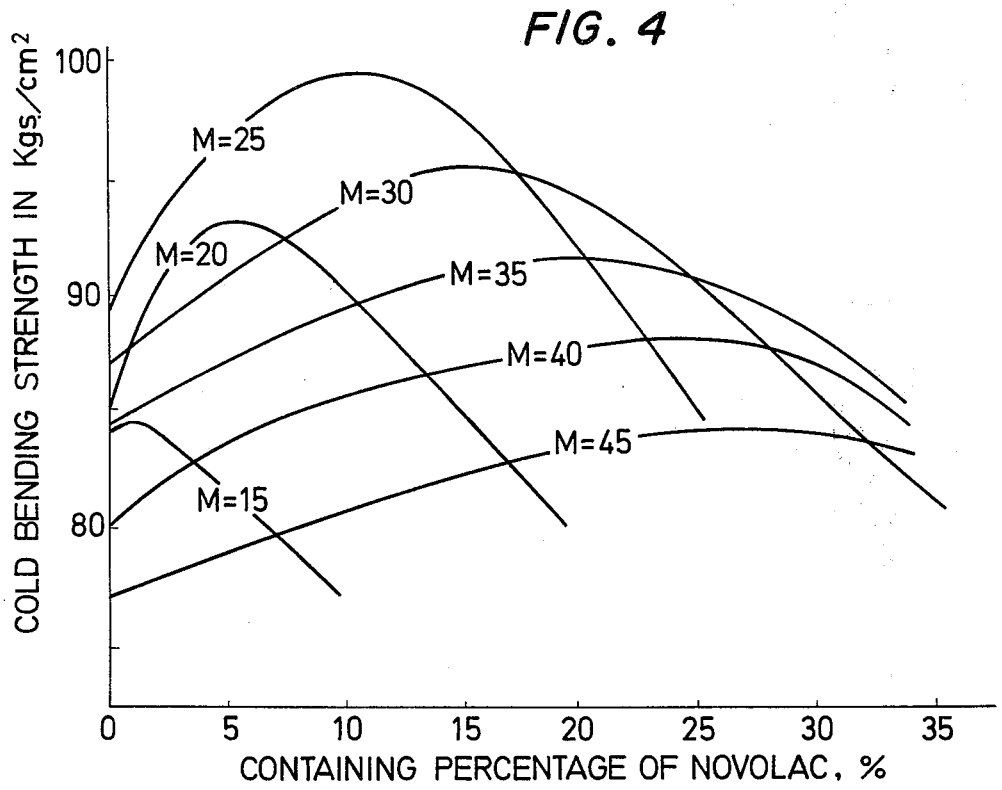
FIG. 4 is a further chart illustrative of the relationship between the cold bending strength and the percentage content of novolac.

In the process according to the invention, a properly selected amount of novolac is added to the ammonia-catalyzed resol having a limited range of methylol indices, thereby obtaining a favorable and effective mutual action, as will become more apparent as the description progresses. In FIG. 4 showing several performance curves as obtainable when such addition of novolac to ammonia-catalyzed resol has been made, the relationship between the cold bending strength and the novolac addition is illustrated. As seen, with methylol index exceeding 15, the strength will be improved with increase of the addition quantity, until an optimal addition quantity of novolac has been attained. With such ammonia-catalyzed resol having the methylol index 15, the resin substantially composed of ammonia-catalyzed resol represents a peak strength, showing an extreme limit beyond which the novolac addition does not benefit the final properties of the resin.

On the other hand, in the case of ammonia-catalyzed resol having a methylol index of 45, even when the strength could be improved by the addition of novolac, it shows a critical strength corresponding to that obtainable with conventional ammonia-catalyzed resol resins. Therefore, ammonia-catalyzed resol having a still higher methylol radicals can not be utilized in practical purposes intended by the present invention. It can be said further that these ammonia-catalyzed resol resins are highly difficult to process into solid resin products or more specifically, solid coating layers to provide the composition according to this invention, capable of being handled in an easy and convenient way.

As shown by the dotted line curve C in FIG. 1, the added quantity of novolac has a critical limit of about 30 wt. % relative to such ammonia-catalyzed resol having a methylol index of 45, because of the fact that a further addition of novolac retards the hardening velocity to an unacceptable degree and leads to an inferior cross linkage density, thus giving rise to inferior baking strength of the final shell products made of the resin-coated sand. The most favorable adding quantity of novolac may be expressed by the formula:

methylol index [M] − 15 when expressed in wt. %, as will be understood from several characteristic curves in FIG. 4.

As may be well understood from the following detailed description, the addition of novolac has an intimate relationship with the intended prevention of gas defects otherwise frequently appearing in the molded castings. As an example, gas defects most frequently appearing in cast steel and high quality cast iron products is caused substantially by the presence of nitrogen and it has been found that if the amount of dissolved nitrogen should exceed about 100 ppm in the molten metal charge, the development of gas defects is suddenly accelerated. Generally speaking, the molten metal contains already in advance of pouring in shell molds approximately 70 – 90 ppm of nitrogen and thus, a further additional absorption of small amount of nitrogen may lead rather sensitively to invitation of gas defects. It should be further noted that once nitrogen is dissolved in the molten iron or steel charge, it is highly difficult to remove and a substantial amount thereof will remain as a residue and accumulate in the molten charge. This disadvantageous strong tendency has been clearly and positively determined by our practical experiments on the formation of gas defects in steel and high quality iron castings which are more liable to suffer therefrom.

If the rate of the discarded castings should increase due to such gas defects, the production cost will disadvantageously increase. A reduction of the nitrogen content in the resin, even of a small amount, will lead to a considerable saving in the production cost. By adopting the addition of novolac as proposed by the invention, an appreciable reduction of the nitrogen content, an increase of the strength of shell molds, and a shortening of the baking period thereof can be positively and reliably attained.

In connection with the term "phenol or its equivalent" as used throughout the specification and in the appended claims, the equivalent may be cresol, xylenol or a mixture of at least two members taken from the group consisting of phenol, cresol and xylenol. In the similar way, the term "formaldehyde or its equivalent" may be at least a member selected from the group consisting of formalin, paraformaldehyde and trioxan.

In the following, the invention will be further described in detail by reference to several numerical examples.

EXAMPLE 1

940 kg of carbolic acid, 1,460 kg of 37%-formalin and 36 kg of 28%-aqueous ammonia were charged into a stainless steel-made autoclave, 3,000 lit. capacity, fitted with reflux condenser, thermometer, agitator and the like auxiliaries, and kept at 70°C for 60 minutes for performing an addition reaction thereamong. Then, the reaction mixture was carefully heated so that the temperature of the charge could not exceed 70°C under reduced pressure of 150 mmHg for the removal of approximately 900 kg of water from the reaction mixture until the latter became substantially transparent and the temperature of the mixture began to rise. While removing the condensation water, being formed with rapid progress of the condensation reaction, under the same reduced pressure, the reaction was continued until the reaction temperature reached 100°C. Upon attainment of this temperature, the reaction mixture was rapidly discharged into a cold water pool for quenching to a solid resin mass.

EXAMPLE 2

940 kg of carbolic acid, 1,620 kg of 37%-formalin and 36 kg of 28%-aqueous ammonia were charged into an autoclave as before and heated at 65°C for 90 minutes for performing an addition reaction. Then, the reaction mixture was carefully heated under reduced pressure of 150 mmHg so as to limit the reaction remperature to 70°C or less, for the removal of approximately 1,000 kg of condensation water from the charge which then became substantially transparent. This reaction mixture was introduced directly; or through a provisional reservoir, into a twin-screw type kneading reactor at a feed rate of 5 kg/min, so as to carry out a condensation reaction in a continuous manner. The condensation water formed with the progress of the condensation was removed progressively from the kneader under reduced pressure of 150 mmHg, while the reaction temperature was carefully controlled, so as not to exceed 100°C. The reaction products were successively discharged and quenched by contact with cold water, to provide solid resin masses.

Several characteristics of the solid resin obtained in the following Table 2.

Table 2

| | Example 1 | Example 2 |
|---|---|---|
| Softening point (as meansured by the ball ring method) | 83 | 80 |
| Gel-forming period (on hot plate 150°C), minutes | 50 | 45 |
| Methylol index | 25 | 29 |

Briefly expressed, the process according to the invention is carried out in such manner that ammonia-catalyzed resol or a combination of ammonia-catalyzed resol and novolac is supplied to hot refractory granules and the mixture is agitated.

In the following, several numerical process examples are given.

EXAMPLE 3

30 kg of fluttery sand (Australian siliceous sand, mean particle size index: 63) heated to 140°C were charged into a foundry sand mixer, 70 r.p.m., and 750 g of the resin prepared in the foregoing Example 1 to 2 were added thereto. Then, the mixture was kneaded for 60 seconds and 600 g of water was added the kneading operation being continued. After about 70 seconds, 30 g of calcium stearate were added and then, the kneading was continued for a further 30 seconds. In this way, freely flowable resin-coated foundry sand for shell molding was obtained.

Several characteristics of the thus processed foundry sand were as follows:

Table 3

| | Example 1 | Example 2 |
|---|---|---|
| Bonding temp., °C (J.S.M.A. method) | 100 | 100 |
| Hardening period, seconds (on hot plate, 5 mm thick, 250°C | | 0 |
| | 48 | 45 |
| Bending strength, kg/cm² (JIS) | 87 | 80 |
| Peal-backs (J.S.M.A.-method) | none | none |
| Fluidity | good | good |
| Hot tensile strength, kg/cm² (J.S.M.A.-method baked, 60 seconds) | 8.8 | 10.5 |

EXAMPLE 4

30 kg of similar Australian siliceous sand, heated to 140°C, were charged into a sand mixer, 70 r.p.m., and 750 g of a mixer resin consisting of 90 wt. % of ammonia-catalyzed resol prepared in Example 1 and 10 wt. % of novolac were added thereto. Then, the mixture was kneaded together for 60 seconds and then 600 g of water was added and the kneading operation was continued. After about 70 seconds, 30 g of calcium stearate were added and the kneading was continued for a further 30 seconds. Then, the mixture was discharged through an exit opening of the machine onto a travelling and oscillating conveyor for cooling. In this way, freely flowable resin-coated sand was obtained which had the following characteristic properties.

Table 4

| | |
|---|---|
| Cold bending strength, kg/cm² | 98 |
| Hot bending strength, kg/cm² | 17 |
| Hardening velocity, seconds (on hot plate, 5mm thick, 250°C) | 48 |
| Blocking tendency | practically none |

EXAMPLE 5

940 kg of carbolic acid and 2,270 kg of 37%-formalin were charged into an autoclave fitted with reflux condenser, agitator and aqueous ammonia reservoir tank to which 72 kg of 28%-ammonia water was introduced dividedly and through a pH-sensing type automatic dispenser. Then, the mixture was kept at 70°C for 120 minutes and then subjected to a dehydrating step under reduced pressure. During this step, the reaction temperature was kept at 70°C at the maximum. Upon removal of 1,330 kg of water, the reaction temperature gradually increased to 105°C. At this point, the charge was discharged rapidly through a discharging outlet of the autoclave for quenching. In this way, a solid resin was obtained.

30 kg of fluttery sand of the same kind as before were charged into a kneading reactor of the type as before and then, 750 g of a mixed resin consisting of 70 wt. % of the resol obtained above and 30 wt. % of novolac were added and kneaded for 60 seconds whereupon 600 g of water were added and the kneading was continued. After about 80 seconds, 30 g of calcium stearate were added and the kneading was continued for further 60 seconds. Then, the charge was discharged onto a travelling and vibrating conveyor for quenching. The thus obtained resin-coated sand represented the following characteristics.

Table 5

| | | |
|---|---|---|
| Resin per se | Softening point, °C (measured as before) | 50 |
| | Gel-forming period (on hot plate, 150°C) | 50 |
| | Methylol index | 45 |
| Coated-Sand | Cold bending strength, kg/cm² | 83 |
| | Hot bending strength, kg/cm² (as measured directly upon baking at 250°C for 45 seconds) | 16 |
| | Hardening velocity, seconds (on hot plate, 250°C) | 48 |
| | Blocking tendency | slightly worse |

The resin and resin-coated sand obtained by the present invention have the following several superior characteristics.

1. Due to substantial reduction of the nitrogen, otherwise frequently encountered gas defects, especially in high quality cast iron (FC 30 - JIS) and cast steel products, can be substantially supressed.

As an evidence thereof will be briefly set forth:

Shell molds were prepared from coated sand with three types of resins (A), (B) and (C).

The resin (A) consisted of novolac added with 15 wt. % of hexamine.

The resin (B) consisted of 100 wt. % of ammonia-catalyzed resol of methylol index: 30.

The resin (C) consisted of said resol (B) added with 20 wt. % of novolac. Coated sand was prepared in three types by use of these three different resins (A), (B) and (C).

With use of these shell molds, cast iron plates were prepared at a casting temperature of 1,460°C, each having a thickness of 35 mm; weight 10.8 kg. Cast iron was FC 30 (JIS) comprising: C 3.02 wt. %; Si 1.88 wt. %; and Mn 0.48 wt. %. The results were as follows, showing a substantial improvement.

Table 6

| Kind of Resin | Number of casting Tests | Observed Gas Defects | Developing Percentage |
|---|---|---|---|
| (A) | 58 | 21 | 36.2 |
| (B) | 58 | 9 | 15.5 |
| (C) | 58 | 2 | 3.4 |

2. Strength reduction and occurrence of blocking due to moisture absorption of the resin are highly slight.

3. Coated sand is highly fluidous. Blowing-in capability of the resin-coated sand is superior.

4. Cold and hot strength of the shell molds prepared from the resin-coated sand can be substantially improved. Especially, the cold strength is amazingly improved, thereby contributing to substantial reduction of the quantity of the coating resin. The improvement of the hot strength shortens the baking period and thus improves the productively of the castings.

5. Peal-back can be reduced substantially.

6. Development of unpleasant ill smelled gases can be reduced to a possible minimum.

7. Hardening can be assured even at the inside center of a heavy core.

Table 7 - A

| Item | Conv. process - 1 | Conv. process - 2 |
|---|---|---|
| | novolac plus hexamine 15 wt. % | ammonia catalyzed resol (of methylol index 8) plus resorcin 7% |
| 1. N-content, % | 6.0 | 1.4 |
| 2. Generated gas quantity | 100 | 94 |
| 3. Composition of gas (ammonia) developed during backing step | 100 | 9.5 |
| 4. Ill smell developed in shell-forming | highly strong | strong |
| 5. Gas defects in cast product (FC 30) | plenty | slight |
| 6. Anti-blocking performance of coated sand due to moisture absorption | ○ | Δ |
| 7. Flowability of coated sand, seconds | 13.6 | 14.2 |
| 8. In-blowability, (wt. of core) | 16.4 | 15.2 |
| 9. Shell separation from master molds | ○ | X |
| 10. Cracking at shell separation | ○ | X |
| 11. Pealback rate, % | 35 | 25 |
| 12. Backing period, seconds (core) | 90 | 95 |
| 13. Uniformity in baking | Δ | X |
| 14. Cold bending strength (I), kg/cm² | 80 | 75 |
| 15. Cold bending strength (II), kg/cm² | 55 | 52 |
| 16. strength reduction, % due to moisture absorption | 15 | 18 |
| 17. Hot bending strength, kg/cm² | 15 | 15 |

Table 7 - A-continued

| Item | Conv. process - 1 | Conv. process - 2 |
|---|---|---|
| | novolac plus hexamine 15 wt. % | ammonia catalyzed resol (of methylol index 8) plus resorcin 7% |
| 18. Thermal seisure | slight | plenty |
| 19. Price of resin | 100 | 115 |

Table 7 - B

| Item | * Inventive process -1 | ** Inventive process-2 (substantially critical) | *** Inventive process-3 (optimal) |
|---|---|---|---|
| 1. N-content, % | 1.2 | 0.8 | 1.0 |
| 2. Generated gas quantity | 87 | 87 | 87 |
| 3. Composition of gas (ammonia) developed during baking step | 8.0 | 5.5 | 6.5 |
| 4. Ill smell developed in shell-forming | weak | slightest | slightest |
| 5. Gas defects in cast products (FC 30) | slight | none | none |
| 6. Anti-blocking performance of coated sand due to moisture absorption | ○ | Δ | ◎ |
| 7. Flowability of coated sand, seconds | 13.0 | 14.5 | 12.3 |
| 8. In-blowability, (wt. of core) | 16.4 | 16.4 | 16.4 |
| 9. Shell separation from master molds | ○ | ○ | ◎ |
| 10. Cracking at shell separation | ○ | ○ | ◎ |
| 11. Pealback rate, % | 5 | 5 | 0 |
| 12. Baking period, seconds (core) | 68 | 68 | 68 |
| 13. Uniformity in baking | ○ | ○ | ◎ |
| 14. Cold bending strength (I), kg/cm² | 87 | 73 | 95 |
| 15. Cold bending strength (II),kg/cm² | 55 | 55 | 58 |
| 16. Strength reduction, % due to moisture absorption | 10 | 15 | 10 |
| 17. Hot bending strength, kg/cm² | 16 | 14 | 17 |
| 18. Thermal seisure | none | none | none |
| 19. Price of resin | 91 | 91 | 91 |

*ammonia catalyzed resol (methylol index 25);
**ammonia catalyzed resol (methylol index 45) plus novolac 30%;
***ammonia catalyzed resol (methylol index 25) plus novolac 10%

In connection with the above Tables 7 - A and 7 - B the following remarks will be set forth.

1. These values appearing in line 1 are those of theoretical relative to resin amount 100.

2. These values appearing in line 2 were measured by a gas-development measuring apparatus of own design and manufacture and used in the factory of the assignee company (Toyota Jidoshokki Seisakusho, Kariya-shi). Measured at 1,300°C. Coated sand sample weighed each 5 g. Conventional representative coated sand was assumed to have a value of 100.

3. These values appearing in line 3 were determined by measurement of developed amount of $NH_3$ per 1 g of resin-coated sand. Conventional representative resin-coated sand was taken as 100 for comparison.

4. These values appearing in line 4 were determined by the mean of the observation results executed by three monitors.

5. 10.5 kg-cast iron plates were prepared and machined at their both surfaces for each 1.5 mm - depth, and possible gas defects were observed.

6. A desiccator charged with saturated aqueous solution of ammonium sulfate was used. Resin-coated sand samples were introduced in the desiccator and placed therein at room temperature for 24 hours.

7. Measuring funnel was used and resin coated sand was caused to drop therethrough.

8. A crank case core was prepared each time by blowing-in of coated sand under same conditions.

9. Crank case cores for an engine cylinder block were prepared with coated-sand. Repeated core-making operations were counted until unallowable troubles should have taken place without use of any parting agent. For this judgement, the appearance of the cores has been carefully inspected.

10. Crackings were observed at the surfaces of the core products obtained at 9).

11. J.S.M.A.-method was utilized for determination.

12. Practical baking period as measured for each of the cores prepared at 9).

13. Axial section was made for each of several test pieces after a predetermined baking period. Test Piece was of 50 mm × 50 mm length.

14. and 15. According to JIS.

16. Said test pieces were used. Measurement was made twice per each test piece, once directly after the baking and secondly, after lapse of 48 hours in which the piece was positioned in a desiccator adjusted to maintain a 100%-relative humidity.

17. Test piece was of 22 mm × 22 mm × 202 mm, length. Baked period was 45 sections at 250°C. Measurement was made directly upon separation from master mold.

18. Several crank case molds were reviewed.

The embodiments of the invention in which an exclusive property or priviledge is claimed are as follows:

1. A process for the preparation of a composition of refractory granules, comprising:

1. reacting 1 mole of at least one member selected from the group consisting of phenol, cresol and xylenol and 1 – 3 moles of at least one member selected from the group consisting of formalin and paraformaldehyde, in the presence of a catalytic amount of at least one member selected from the group consisting of ammonia, a primary amine and a secondary amine at 50° – 70°C for performing an addition-condensation reaction;

2. keeping the reaction mixture under reduced pressure at 70°C or lower, as measured by the temperature of the products for dehydration until the products become substantially transparent;
3. further keeping the reaction mixture under reduced pressure for removal of aqueous condensate formed by self- condensation until the temperature of the reaction mixture reaches 90° – 120°C;
4. quenching the reaction mixture directly upon arrival of the temperature of the reaction mixture at the last mentioned temperature range, thereby forming a resol type phenolic resin having a softening point higher than 80°C; and
5. thereafter mixing 70 – 100wt. % of said resol type phenolic resin with 0 – 30wt. % of a novalac-type phenolic resin, together with refractory granules kept at a temperature of at least 80°C until the granules attain a freely flowing state.

2. The process as set forth in claim 1 wherein the resin consists substantially of said resol type phenolic resin.

3. The process as set forth in claim 2 wherein said resol-type phenolic resin contains methylol radicals in a range of 15 – 30 as expressed by methylol index.

4. The process as set forth in claim 1 wherein said resol-type phenolic resin contains methylol radicals with a range of 15 – 45 when expressed by methylol index and the content of said novolac-type phenolic resin as measured in weight % and expressed by (N) and the amount of said resol-type phenolic resin methylol index as measured in weight % (M) are controlled mutually by the following formula:

$$[N] = [M] - 15.$$

5. A resol-type phenolic resin shaped into solids adapted for coating of refractory granules for molds and prepared by the first to fourth steps of claim 1.

6. A resol-type phenolic resin as set forth in claim 5, methylol radicals contained in said resin being in a range of 15 – 45 as expressed by methylol index.

7. The resin as set forth in claim 5 mixed with solid novolac-type phenolic resin.

8. A resin composition comprising the resol-type phenolic resin of claim 6, mixed with an amount of solid novolac-type phenolic resin in a wt. % as expressed by [M] − 15, wherein [M] is the methylol index of said resol-type phenolic resin.

* * * * *